US005318267A

United States Patent [19]

Rast

[11] Patent Number: 5,318,267

[45] Date of Patent: Jun. 7, 1994

[54] TREE STAND

[76] Inventor: T. Marlin Rast, 235 2nd Avenue, NW., Swift Current, Saskatchewan, Canada, S9H 0P4

[21] Appl. No.: 951,093

[22] Filed: Sep. 25, 1992

[51] Int. Cl.[5] ..... F16M 13/00

[52] U.S. Cl. ..... 248/523; 248/542

[58] Field of Search ..... 248/519, 523, 511, 524, 248/525, 526, 527, 188.7, 542; 47/40.5

[56] References Cited

U.S. PATENT DOCUMENTS

| | | | |
|---|---|---|---|
| 2,733,032 | 1/1956 | Farley et al. | 248/527 X |
| 4,261,138 | 4/1981 | St. George Syms | 248/523 X |
| 4,571,881 | 2/1986 | Lathim | 248/527 X |
| 4,571,882 | 2/1986 | Capen | 47/40.5 |
| 5,076,009 | 12/1991 | Cibor | 47/40.5 |
| 5,090,655 | 2/1992 | Bisson | 248/519 X |
| 5,157,868 | 10/1992 | Munoz | 47/40.5 |

*Primary Examiner*—Ramon O. Ramirez

*Attorney, Agent, or Firm*—Hovey, Williams, Timmons & Collins

[57] ABSTRACT

A self-supporting base having legs that overlap to geometrically interlock in a structural brace can advantageously support such articles as a plastic tree stand container without creating undue stress in the plastic. The resultant tree stand additionally contains a water level indicator having a transparent hose that is retained at its upper end by a special fastener.

16 Claims, 3 Drawing Sheets 20
16
10
88
14
16
104
26
100
92
82
78
5
5
102
22
88
-90-
16
84
94
88
88
16
24

106
104
86
108
18
102

10
16
83
104
84
16
16
102
84
18

-92-
14
22
26
12
24
56

TREE STAND

BACKGROUND OF THE INVENTION

1. Field of the Invention

The present invention relates to a structural support base wherein the legs of the base overlap to form an interlocking geometric pattern for independently supporting articles that are placed upon the base. More particularly, the base is formed entirely from interlocking leg members alone, and it is capable of advantageously supporting such articles as a plastic tree stand container.

2. Description of the Prior Art

A variety of Christmas tree holders are known in the art. These devices typically incorporate a dish or pan for holding water, three or four legs that contact the floor, a number of threaded bolt-type members, and structure associated with the legs for assisting the bolt members in supporting a centrally positioned tree. The tree is typically cut at its lowermost point, which condition means that it has been permanently separated from its root structure. These traditional types of devices are most often made of metal.

Manufacturers have attempted to advantageously employ high density plastic in place of the traditionally metal tree stand pan, but problems exist that have limited the potential applications for plastic construction. As compared to metal constructs, plastic at least offers the potential advantages of economy in production and a rust-free product life. Unfortunately, plastic tree stand containers are not often seen commercially, because plastic has a tendency to creep or otherwise deform under the heavy loading that tree stands generally must endure. The tree stand must continuously bear the weight of a heavy tree for a substantial period of time, and plastic deformation fatigue failure can cause a very short product life if the plastic is not adequately supported. Particularly, the interaction between the prior art structural legs and the plastic tree stand container causes unwarranted stress in the plastic container.

SUMMARY OF THE INVENTION

The problems outlined above are substantially present invention. That is to say, the stand hereof incorporates a plastic tree stand container that is not readily deformable under normal loading conditions, because the invention also incorporates a support base formed from a number of legs that interlock to support the dish without unduly straining the plastic.

In a broad sense, the support base of the present invention incorporates a number of legs that come together in a geometric pattern (e.g., a square or a triangle) to overlap and interlock for withstanding a loading force. In more preferred forms, flexible fasteners couple the legs with one another to retain them interlocked in their geometric configuration. Even without these preferred fasteners, however, the legs themselves form a self-supporting base by means of a structural brace overlap type of interlocking geometrical pattern. In other preferred forms, the legs each incorporate a curved section on one end that assists the legs in interlocking with one another.

In particularly preferred forms, the invention contemplates a tree stand container or other platform that rests on top of the support base described above. The platform is designed for supporting articles, and it has a bottom that incorporates channel fasteners for holding the legs of the support base together in their interlocked position. Additionally, particularly preferred forms of the tree stand incorporate an external water level indicator having a special retaining means. Assembly is quick and easy because the process requires no hand tools.

DESCRIPTION OF THE PREFERRED EMBODIMENT

Figure 2:
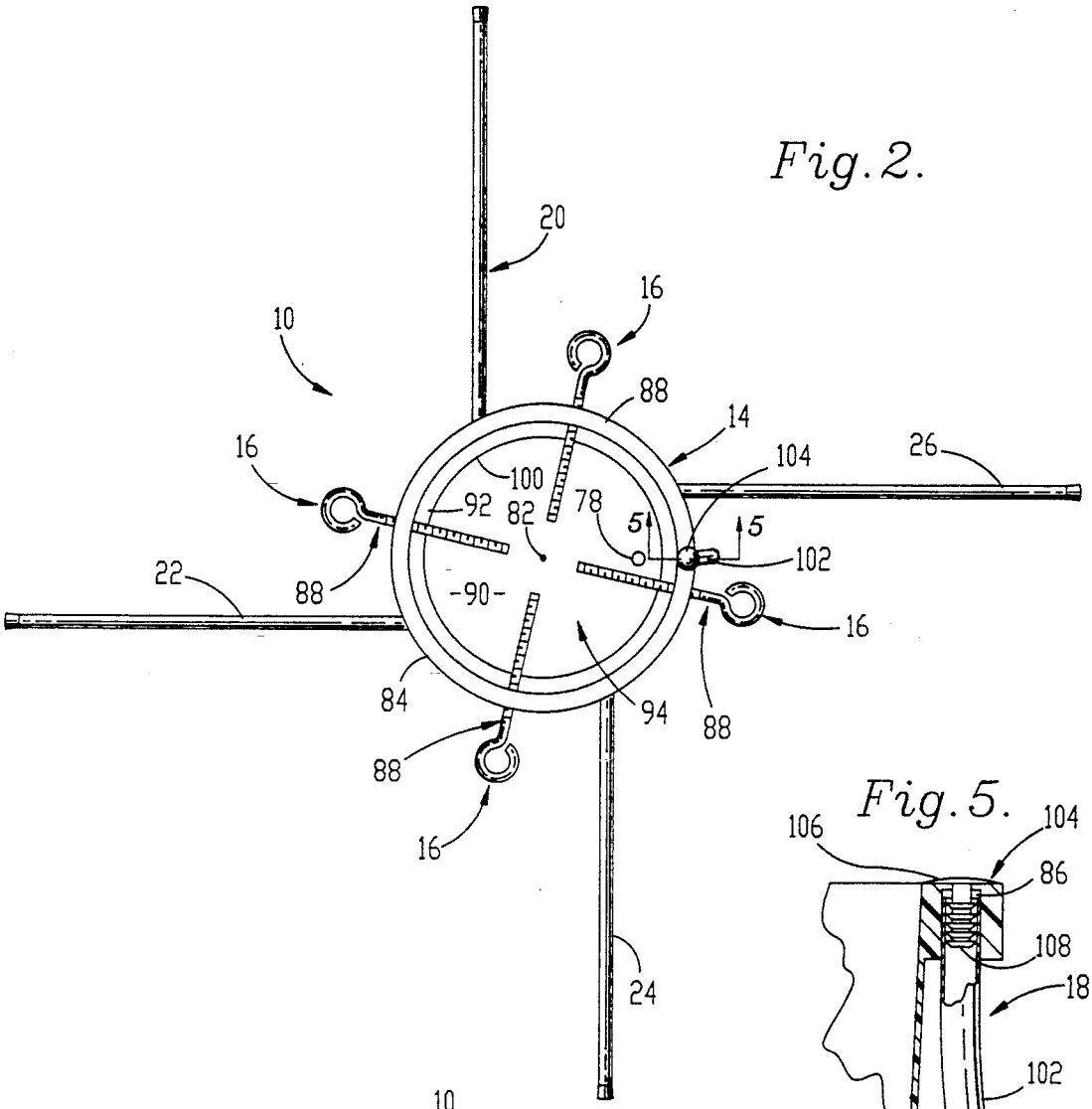
FIG. 2 is a top plan view of the tree stand.

Referring now to FIGS. 1–4, tree stand 10 broadly includes a multi-legged support base 12, a tree-receiving container 14 on top of base 12, threaded fasteners 16 for retaining the tree by its trunk within container 14, and water level indicator 18.

Figure 10:
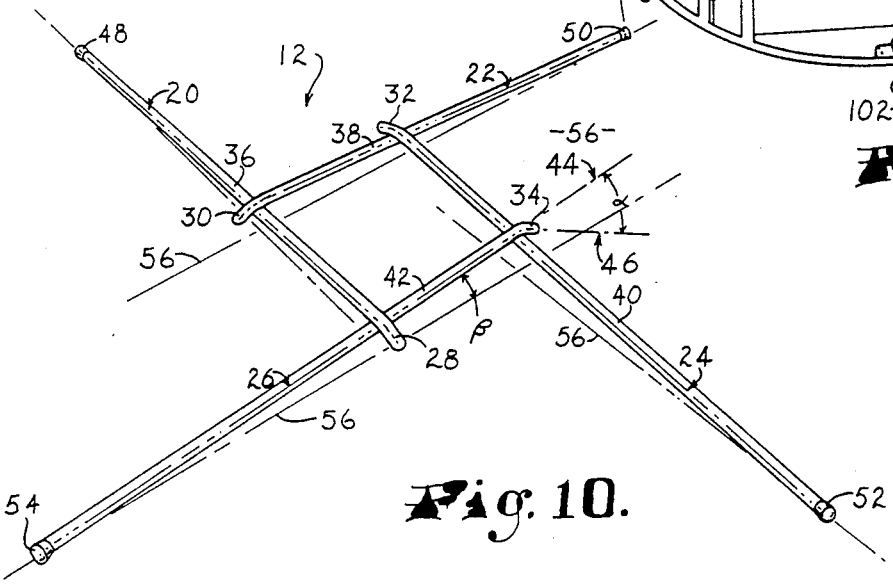
FIG. 10 shows four legs of the preferred support base interlocked in a self-supporting geometric pattern.

FIG. 10 shows support base 12 assembled in a square structural brace overlap type of interlocking geometric pattern. Legs 20–26 are substantially identical, and they are formed from $\frac{3}{8}''$ diameter high strength steel rods. Each of legs 20–26 has a respective end segment 28–34 and a respective main body 36–42. As seen in the example of leg 26, line 44 represents a projected central axis of symmetry in the main body 42 of leg 26. Similarly, projected line 46 represents a central axis of symmetry in end segment 34 of leg 26. The angle $\alpha$ measures the angle between lines 44 and 46. The projected lines 44, 46 show that segment 34 exists in an angularly skewed and downwardly curved relationship with main body 42. This relationship exists because end segment 34 incorporates a curved section to produce angle $\alpha$. Although each of the legs 20–26 has been illustrated in its preferred form as having an end segment 34 of some significant length that extends beyond the downturned curve or crook in the leg, it will be appreciated that each leg could dispense with the end segment 34 and terminate immediately after the hump or curve presented by the crook.

Legs 20–26 each include a respective end cap 48–54. Note that number 56 represents the floor of a structure or building and that angle $\beta$, which measures between line 44 and floor 56, represents the rise of leg 26 from leg end cap 54 to leg end segments 34. A similar angle $\beta$ exists for all legs 20–26, and the most preferred angle $\beta$ ranges between 2° and 5° to yield a slightly positive rise along legs 20–26. The magnitude of angle $\beta$, however, is not critical to the invention as long as legs 20–26 can reasonably resist against forces that could overturn the base. In particularly preferred forms, the angle $\alpha$ ranges between 15° and 40°.

Figure 3:
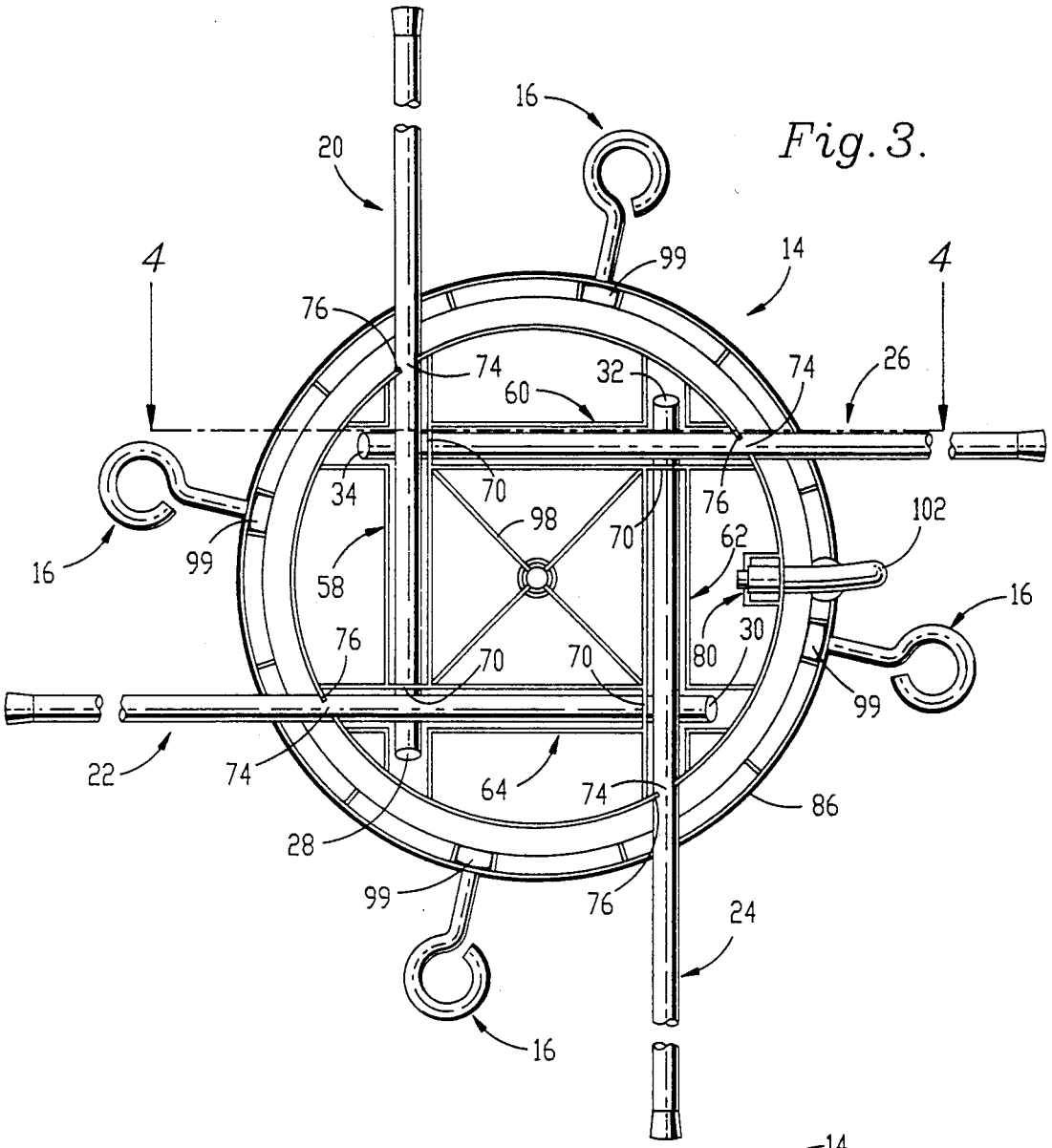
FIG. 3 is a bottom view showing the geometrical relationship between the supporting leg members as they fit into the grooves and apertures that retain them.
Figure 4:
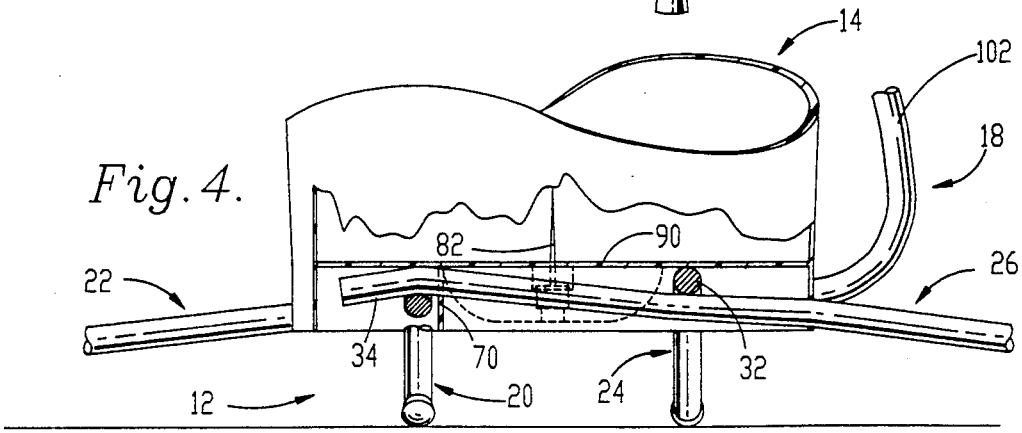
FIG. 4 is a sectional view taken along line 4—4 of FIG. 3.
Figure 6:
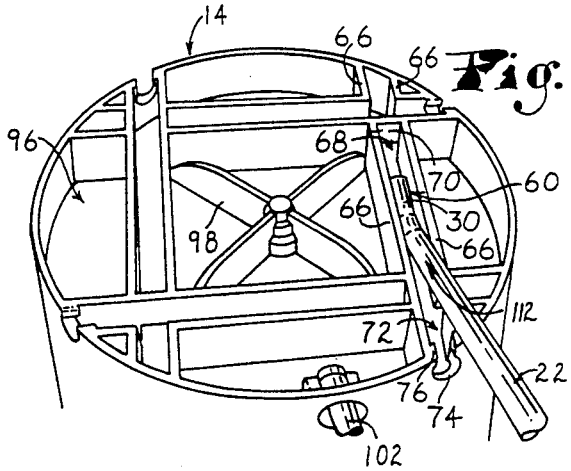
FIG. 6 shows the bottom of the tree stand container as a leg member is just being inserted.
Figure 7:
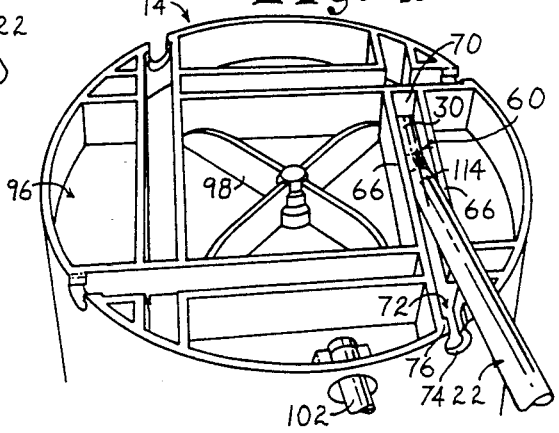
FIGS. 7, 8, and 9 show an exemplary sequence of events during the insertion of the leg subsequently to the step that is depicted in FIG. 6.
Figure 8:
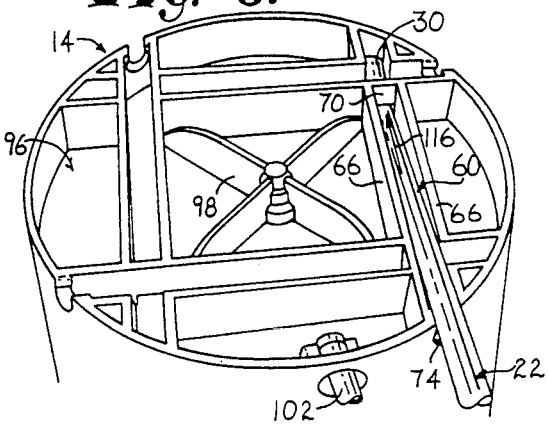
Figure 9:
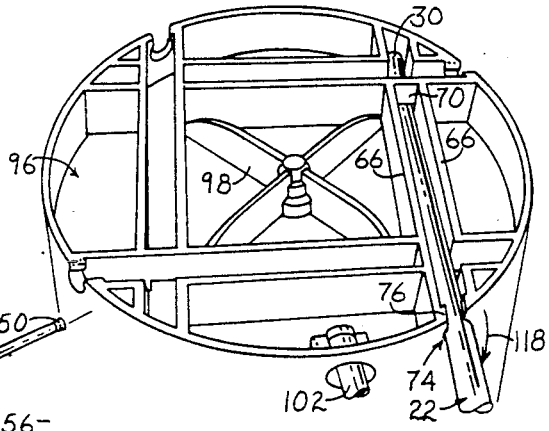

FIG. 3 shows a bottom view of container 14 with legs 20–26 installed for retention in the structural brace overlap type of interlocking geometric pattern of FIG. 10. Container 14 is formed with four channel grooves 58–64, with each channel groove corresponding to a given leg 20–26. As seen in FIG. 6, channel groove 60 includes sidewalls 66, aperture 68, cross piece 70, bottom surface 72, and snap lock 74. Snap lock 74 is of rounded dimensions and includes flexible lip 76 for retaining leg 22 in place. Channel groove 60 forms an example for the other grooves 58,62,64, because all channel grooves 58–64 have a similar construction, and they act to retain legs 20–26 in a self-supporting interlocked manner.

Figure 5:
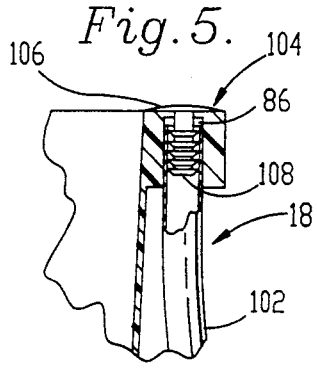
FIG. 5 shows a sectional view taken along line 5—5 of FIG. 2.
Figure 1:
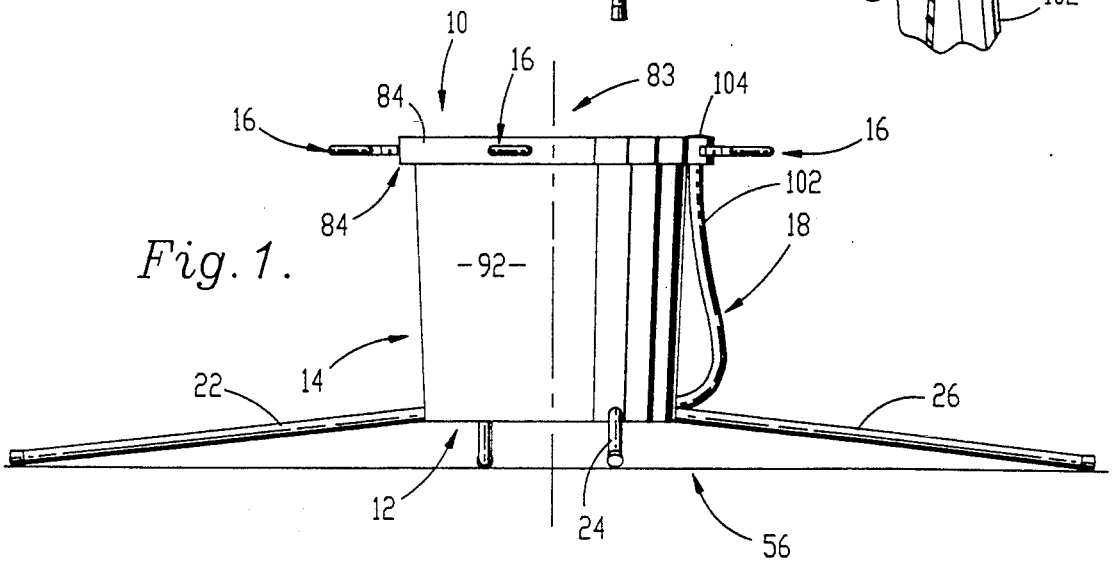
FIG. 1 is a front view of the preferred tree stand, in accordance with the present invention.

As can be seen primarily in FIGS. 1, 2, and 5, container 14 has additional features that function well in the preferred tree stand, including water aperture 78 near the bottom of the container, nipple 80 (FIG. 3) associated with aperture 78, upright spike 82 in the center of the floor of the container, rim 84 around the top of the container, hose aperture 86 (FIG. 5) in rim 84, horizontally extending threaded apertures 88 in the side of rim 84, bottom wall 90, and container side wall 92. Water aperture extends through bottom 90 from the interior side 94 to the exterior side 96 (FIG. 6), and nipple 80 forms structure around the aperture 78 as it passes through to the exterior side 96 of bottom wall 90. Spike 82 extends upwardly from the approximate midpoint of interior side 94 along an approximate central axis of symmetry 83 in platform 14. Exterior side 96 incorporates central cross-brace system 98 (FIG. 6) to support the portion of spike 82 that protrudes through bottom 90. Hose aperture 86 extends through rim 84 which depends from the top of side wall 92. Rim 84 incorporates threaded apertures 88, which extend through rim 84 and include structure for mounting a standard threaded metal nut 99 (FIG. 3) for accommodating the threads of threaded fasteners 16 as they pass through apertures 88. Note that threaded fasteners 16 are ordinary eye bolts. Side wall 92 conically tapers inwardly and downwardly to present a lesser diameter at bottom joint 100 (where bottom 90 meets side wall 92) than at the top of container 14.

Water level indicator 18 includes transparent hose 102 and retainer 104 (FIG. 5). Hose 102 fits around nipple 80, and it may be bound there around its circumference by means of a metal band or clip (not depicted) to prevent fluid leaks. As seen in FIG. 5, retainer 104 has a head 106 and body 108, and it is otherwise known as a commercially available type of automotive fastener. Body 108 has a series of protrusions 110 that slightly exceed the diameter of hose 102. These protrusions 110 do not extend around the entire circumference of body 108, but they are formed in semi-spherical shapes extending radially and outwardly with vertically oriented gaps between the shapes. This configuration allows air to flow in and out of hose 102 through the end of hose 102 that is connected to retainer 104. The head 106 of retainer rests against the outer, upper face of rim 84 to hold the tube 102 up in its position within the aperture 86 in the rim 84.

A consumer may assemble tree stand 10 by inserting threaded fasteners 16 into threaded apertures 88 and also inserting legs 20–26 into respective channel grooves 58–64. Advantageously, hand tools are not required. As an example of the required leg insertion procedure, FIGS. 6–9 depict the sequence of steps that result in the insertion of leg 22 into groove 60. Arrows 112 to 118 depict the general directions of movement as the consumer inserts leg 22. Arrow 112 shows that end 30 of leg 22 is placed in groove 60 to face aperture 68. Arrows 114, 116 show that end 30 travels toward and then through aperture 68. Arrow 118 shows that leg 22 is pressed downwardly through lip 76 of snap lock 74 where it is removable held in place. All of legs 20–26 are assembled in this manner until they rest in grooves 58–64 and in such a way that the square structural brace overlap interlocking geometric pattern of FIG. 10 is preserved.

In use, tree stand 10 holds a cut tree (not depicted) in a vertical orientation with the cut end down and impaled by spike 82. Threaded fasteners 16 serve to adjustably support the tree from the sides. The legs of support base 12 extend outwardly to prevent stand 10 from tipping over on its side. The consumer may desire to keep the tree fresh by placing water (not depicted) inside container 14, which forms a sort of watertight bucket. The water will flow through aperture 78 and into transparent hose 102 where the water level will be visible from the outside.

It will be appreciated that although the snap locks 74 securely 20–26 in place on the bottom of the container 14, there is little or no weight transferred from the container to the legs at that location. Instead, the main load-bearing contact between the container 14 and the brace 12 occurs at the "humps defined by the intersection of each downturned end segment 28–34 with its main leg section 36–42 (see FIG. 4 for example). Thus, creep and wear of the plastic at locks 74 is minimized.

Of course, the invention as described herein is given by way of example and not by way of limitation. Most particularly, the disclosure includes a tree stand, but this should not be seen as a necessary limitation on the structural brace itself. Any number of different types of objects and devices could be supported on the brace.

Additionally, support base 12 may incorporate a variety of geometric patterns, e.g., triangular, square, pentagonal, and octagonal. These patterns are all produced in a similar manner in that leg end portions overlap the main bodies of other legs to produce a support base. The minimum practical number of legs is three, and all of these variations fall within the spirit of the invention.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

I claim:

1. A base for supporting articles, comprising a plurality of legs, there being at least three of the legs, the legs having means for structural brace geometrical overlap interlocking contact with one another, said structural brace means including each leg having a main body and an end segment, the end segment of each leg having structure for overlapping contact with the main body of another leg, and each leg end segment having a curve forming an angular relationship with the main body.

2. The base as set forth in claim 1, further including means for retaining the legs in an interlocked position.

3. The support base as set forth in claim 2, the retaining means including flexible fasteners presenting means for snap assembly of the legs without requiring hand tools.

4. A tree stand, comprising:

a plurality of threaded members;

a support base formed of at least three legs, each leg having an angularly formed end for structural brace geometric overlap interlocking contact with the other legs; and a container presenting at least a bottom and a side wall, the side wall rising upwardly and having threaded apertures for accommodating the threaded members, the threaded members projecting at least generally radially inwardly from the threaded apertures, the bottom having an interior surface and an exterior surface, the exterior surface including a plurality of recesses for accommodating the legs, each recess having structure defining means for holding a leg in an interlocked relationship with the other legs.

5. A tree stand, comprising:

a plurality of threaded members;

a support base formed from at least leg having an angularly formed end for structural brace geometric overlap interlocking contact with the other legs;

a container for placement upon the support base and presenting at least a bottom and a side wall, the bottom having an interior surface and an exterior surface, the exterior surface further having a nipple presenting structure around an aperture for fluid communication between the interior and exterior surfaces of the bottom, the side wall rising vertically and having threaded structure defining side apertures for accommodating the threaded members projecting radially inwardly from the side wall; and a transparent fluid level indicator for visually checking the fluid level inside the bucket, the indicator having an upper and a lower end, the upper end coupled with structure on the side wall, the lower end coupled with the nipple.

6. A stand for supporting an article, comprising:

a support base having at least three legs, the legs having means for structural brace geometrical overlap interlocking contact with one another; and an article-receiving structure on top of the base having means for holding the legs of the support base together in a cooperative interlocked position such that the legs may support the structure, said structural brace means including each leg having a main body and an end segment, the end segment of each leg having structure for overlapping contact with the main body of another leg.

7. The stand as set forth in claim 6, the structure further including at least a bottom and a side wall defining an interior cavity for containing various materials, the structure resting on top of the support base.

8. The stand as set forth in claim 6, including the leg end segments each having a curve forming an angular relationship with the main body.

9. The stand as set forth in claim 6, including the leg end segments each having a curve forming an angular relationship with the main body, the angular relationship ranging between about 15 and 40 degrees.

10. The stand as set forth in claim 7, including the interior cavity affixed at a junction between the bottom and the side wall for containing liquid material inside the interior cavity.

11. The stand as set forth in claim 6, the structure presenting an interior surface and an exterior surface, the exterior surface having a plurality of apertured recesses for retaining the legs an interlocked position.

12. The stand as set forth in claim 10, including the structure having an interior side and an exterior side, the exterior side having means defining an aperture for fluid communication between the interior and the exterior sides, the exterior side further having a nipple around the means defining an aperture.

13. The stand as set forth in claim 12, further including a transparent hollow tube for use as a visual water level indicator, the tube having a lower end and an upper end, the lower end coupled with the nipple, and the upper end coupled with the platform side wall.

14. The stand as set forth in claim 13, including a fastener for coupling the tube upper end with the platform side wall.

15. The stand as set forth in claim 7, further including a plurality of threaded members for providing lateral support to material inside the interior cavity, the platform side wall incorporating structure defining threaded apertures for inwardly accommodating the threaded members extending approximately toward an axis of symmetry in the platform interior cavity, the bottom presenting an interior surface, the interior surface having a spike projecting upwardly approximately along the axis of symmetry.

16. A stand for supporting an article, comprising:

a support base having at least three legs, the legs having means for structural brace geometrical overlap interlocking contact with one another; and an article-receiving structure on top of the base having means for holding the legs of the support base together in a cooperative interlocked position such that the legs may support the structure, the legs extending downwardly for raising the platform above a surface upon which the stand rests, and the legs extending outwardly for resisting the overturning of the stand.

* * * * *